US010738747B2

(12) United States Patent
Lee et al.

(10) Patent No.: US 10,738,747 B2
(45) Date of Patent: Aug. 11, 2020

(54) INJECTOR

(71) Applicant: HYUNDAI KEFICO CORPORATION, Gunpo, Gyeonggi-do (KR)

(72) Inventors: Kang Hun Lee, Seoul (KR); Bong Woo Ryu, Gyeonggi-do (KR); Joon Hee Park, Incheon (KR)

(73) Assignee: HYUNDAI KEFICO CORPORATION, Gunpo-si, Gyeonggi-do (KR)

( * ) Notice: Subject to any disclaimer, the term of this patent is extended or adjusted under 35 U.S.C. 154(b) by 0 days.

(21) Appl. No.: 16/234,312

(22) Filed: Dec. 27, 2018

(65) Prior Publication Data

US 2019/0203683 A1 Jul. 4, 2019

(30) Foreign Application Priority Data

Dec. 28, 2017 (KR) ..... 10-2017-0182270

(51) Int. Cl.

| | |
|---|---|
| ***F02M 51/06*** | (2006.01) |
| ***F02M 63/02*** | (2006.01) |
| ***F02M 61/16*** | (2006.01) |

(52) U.S. Cl.

CPC .... *F02M 51/0614* (2013.01); *F02M 51/0682* (2013.01); *F02M 61/168* (2013.01); *F02M 63/0275* (2013.01); *F02M 2200/16* (2013.01); *F02M 2200/8046* (2013.01)

(58) Field of Classification Search

CPC ..... F02M 51/0614; F02M 51/0682; F02M 61/168; F02M 63/0275; F02M 2200/16; F02M 2200/8046

USPC ..... 123/470, 472, 476, 478; 251/129.09, 251/129.15, 129.21; 239/585.1

See application file for complete search history.

(56) References Cited

FOREIGN PATENT DOCUMENTS

| | | | |
|---|---|---|---|
| JP | 2007016774 | A | 1/2007 |
| JP | 2010203237 | A | 9/2010 |
| KR | 10-2013-0105832 | A | 9/2013 |

OTHER PUBLICATIONS

Office Action corresponding to Korean Patent Application No. 10-2017-0182270, dated Feb. 25, 2019, 3 pages.

*Primary Examiner* — Hai H Huynh

(74) *Attorney, Agent, or Firm* — Mintz Levin Cohn Ferris Glovsky and Popeo, P.C.; Peter F. Corless

(57) ABSTRACT

An injector for injecting fuel, which is introduced from a fuel rail, into an engine to supply the fuel thereto is provided. In particular, the injector includes a housing, an electromagnetic generation unit accommodated in the housing and formed to generate an electromagnetic field when electric power is applied thereto, a core inserted into a fuel-rail-side end of a bobbin to form a magnetic circuit using the generated electromagnetic field, a lead pipe inserted into an engine-side end of the bobbin to form the magnetic circuit by coupling with the core, a molding unit formed to enclose the electromagnetic generation unit and an outer peripheral surface of the core to block introduction of moisture, and a cover coupled to the outer peripheral surface of the core to constitute the magnetic circuit together with the core.

6 Claims, 11 Drawing Sheets

Related Art

INJECTOR

CROSS-REFERENCE TO RELATED APPLICATION

This application claims priority to Korean Patent Application No. 10-2017-0182270, filed on Dec. 28, 2017, the disclosure of which is incorporated herein by reference in its entirety.

TECHNICAL FIELD

The present disclosure relates to an injector, and more particularly, to an injector for injecting fuel, which is introduced from a fuel rail, into an engine to supply the fuel thereto.

RELATED ART

A fuel injection valve for a fuel injection device of a conventional internal combustion engine is generally configured as an electromagnetically-actuated valve and includes a substantially tubular core that is enclosed by a magnetic coil and used as an inner pole and partly as a fuel passage. The magnetic coil is fully enclosed in the circumferential direction of, e.g., a ferromagnetic outer valve jacket (housing) that is implemented in stages in the form of a sleeve and is an external magnetic circuit component used as an outer pole. The magnetic coil, the core, and the valve jacket (housing) form an electrically-excited actuation member.

The magnetic coil with a winding, which is embedded in a coil body, encloses a valve sleeve (lead pipe), and the core is inserted into the inner opening of the valve sleeve (lead pipe), which extends concentrically with respect to a valve longitudinal axis. The valve sleeve is elongated and is implemented as a thin wall. The opening is used as a guide opening for a valve needle that is axially movable, in particular, along the valve longitudinal axis. The valve sleeve extends axially, e.g., over half the total axial length of the fuel injection valve.

In addition to the core and the valve needle (needle shaft), a valve seat is disposed in the opening. The valve seat is fixed to the valve sleeve (lead pipe), for example, by a weld seam. The valve seat has a fixed valve seat surface. The valve needle (needle shaft) is formed, for example, by a tubular armature, likewise a tubular needle section and a ball-shaped valve closing body, in which case the valve closing body is connected to the needle section, for example, by a weld seam. A port-shaped injection aperture disk, for example, is disposed on the downstream end surface of a valve seat body, and an annular support edge bent along the circumference of the disk is directed upward in a direction opposite to the flow thereof. The valve seat body and the injection aperture disk are securely interconnected, for example, by an annular sealing weld seam. Since one or more transverse openings are disposed in the needle section of the valve needle, the fuel flowing through the armature in the inner longitudinal bore may be discharged to the outside and flow to the valve seat surface along the valve closing body, e.g., a flat portion.

The injection valve is electromagnetically operated in a known manner. In order to axially move the valve needle (needle shaft) and open or close an orifice against the spring force of the spring acting on the valve needle, an electromagnetic circuit is used that includes the magnetic coil, the inner core, the outer valve jacket, and the armature. The end of the armature, which is away from the valve closing body, is directed to the core. A cover portion used as an inner pole, for example, is provided in place of the core, and the cover portion closes the magnetic circuit.

The ball-shaped valve closing body interacts with the valve seat surface of the valve seat body, which is tapered in a truncated conical shape in the flow direction, and the valve seat surface is formed axially in the valve seat body at the downstream side of the guide opening. The injection aperture disk includes four nozzles formed by at least one of, e.g., erosion, laser drilling, or stamping.

The insertion depth of the core in the injection valve is crucial, especially for the stroke of the valve needle. One end position of the valve needle is determined by allowing the valve closing body to come into contact with the valve seat surface of the valve seat when the magnetic coil is not excited, whereas the other end position of the valve needle is determined by allowing the armature to come into contact with the downstream core end when the magnetic coil is excited. The stroke is adjusted by the axial movement of the core, and the core is subsequently connected to the valve sleeve according to the predetermined position thereof.

In addition to a return spring, a control member in the form of a control sleeve, which extends concentrically with respect to the valve longitudinal axis and is used to supply fuel in the direction of the valve seat surface, is inserted into the flow bore of the core. The control sleeve (tube) is used to control the spring prestress of the return spring coming into contact with the control sleeve, and the return spring is supported on the valve needle in the armature region by oppositely-disposed sides, in which case an amount of dynamic injection is also regulated by the control sleeve. A fuel filter is disposed above the control sleeve within the valve sleeve.

The inflow-side end of the valve is formed by a metal-made fuel inflow sleeve that is enclosed by a plastic injection molding unit (molding unit) which stabilizes, protects, and encloses the metal-made fuel inflow sleeve. The flow bore (extension tube) of the fuel inflow sleeve, which extends concentrically with respect to the valve longitudinal axis, is used for introduction of fuel. The plastic injection molding unit (molding unit) is formed, for example, such that the valve sleeve and the valve jacket-related portions are directly enclosed by plastic.

However, since the conventional injector of the related art is under the condition that high-temperature and low-temperature environments are repeated during the operation of the engine and is always exposed to moisture, there is a possibility that moisture is introduced into the injector and an insulation failure may occur to cause a short circuit by a contact with moisture.

In other words, since both axial ends of the bobbin are in contact with the core and the housing in the conventional injector as illustrated in FIG. 1 of the related art, the molding unit is not inserted to the inner peripheral surface of the bobbin. Hence, a space is generated between the bobbin and the core or between the core and the housing under the condition of high or low temperature or high moisture, and a failure occurs due to short circuit when moisture flows into the space 1 or 2 (in the direction indicated by the arrows) and reaches a terminal 3, to which electric power is applied, through the space which is not filled with resin, in the injector.

Accordingly, it is necessary to develop a plastic injection molding unit (molding unit) structure capable of blocking the introduction of moisture under harsh conditions.

SUMMARY

The present disclosure has been made in view of the above problems relating to the conventional injector, and an object thereof is to provide an injector capable of preventing introduction of moisture under harsh environment.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

To accomplish the above object, in accordance with an aspect of the present disclosure, an injector for supplying an engine with fuel introduced from a fuel rail is provided. The injector may include a housing, an electromagnetic generation unit accommodated in the housing and formed by winding a coil on an outer peripheral surface of a bobbin to generate an electromagnetic field when electric power is applied to the electromagnetic generation unit, a core inserted into a fuel-rail-side end of the bobbin to form a magnetic circuit using the electromagnetic field generated in the electromagnetic generation unit, a lead pipe inserted into an engine-side end of the bobbin to form the magnetic circuit by coupling with the core, and a molding unit formed to enclose the electromagnetic generation unit and an outer peripheral surface of the core to block introduction of moisture. The molding unit may be inserted into a space between an inner peripheral surface of the bobbin and the outer peripheral surface of the core to seal a gap between the electromagnetic generation unit and the core. Further, the injector may include a cover coupled to the outer peripheral surface of the core to form the magnetic circuit together with the core.

The core may include an insertion part inserted into the inner peripheral surface of the bobbin to form the magnetic circuit by coupling with the electromagnetic generation unit, a molding coupling part connected to a fuel-rail-side end of the insertion part and having an outer diameter smaller than the insertion part for insertion of the molding unit, and a coupling jaw part connected to a fuel-rail-side end of the molding coupling part. The coupling jaw part may support the cover and have an outer diameter greater than the insertion part to allow the coupling jaw part to be accommodated in the bobbin.

The bobbin may include a bobbin body with the coil wound on an outer peripheral surface of the bobbin body, and the core and the lead pipe may be inserted into an inner peripheral surface of the bobbin body. The bobbin may include a first injection part connected to a fuel-rail-side end of the bobbin body, and the first injection part may include a core accommodation groove formed circumferentially for accommodation of the coupling jaw part and a first molding inlet into which the molding unit is inserted to prevent introduction of moisture. The bobbin may further include a second injection part connected to an engine-side end of the bobbin body. The second injection part may supportably abut the housing and include a second molding inlet into which the molding unit is inserted to prevent introduction of moisture.

The cover may have a diameter greater than the coupling jaw part to axially cover the coupling jaw part, include an injection groove formed for exposure of the first molding inlet, and include a cut part formed to enlarge an insertion space of the molding unit.

The molding unit may include a molding unit body accommodated in the housing and formed to enclose an outer peripheral surface of the electromagnetic generation unit, an outer peripheral surface of the coupling jaw part, and an outer peripheral surface of the cover. The molding unit may further include a housing sealing part formed to extend from the molding unit body to seal a fuel-rail-side end of the housing, and a first sealing part formed to extend from an inner peripheral surface of the molding unit body. The first sealing part may pass through the first molding inlet and enclose an outer peripheral surface of the molding coupling part. The molding unit may further include a second sealing part formed to extend from the molding unit body, which may pass through the second molding inlet and enclose the inner peripheral surface of the bobbin.

The lead pipe may include a pipe body inserted into the bobbin, and a molding accommodation part formed on an outer peripheral surface of the pipe body and formed circumferentially in a groove shape for accommodation of the molding unit.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
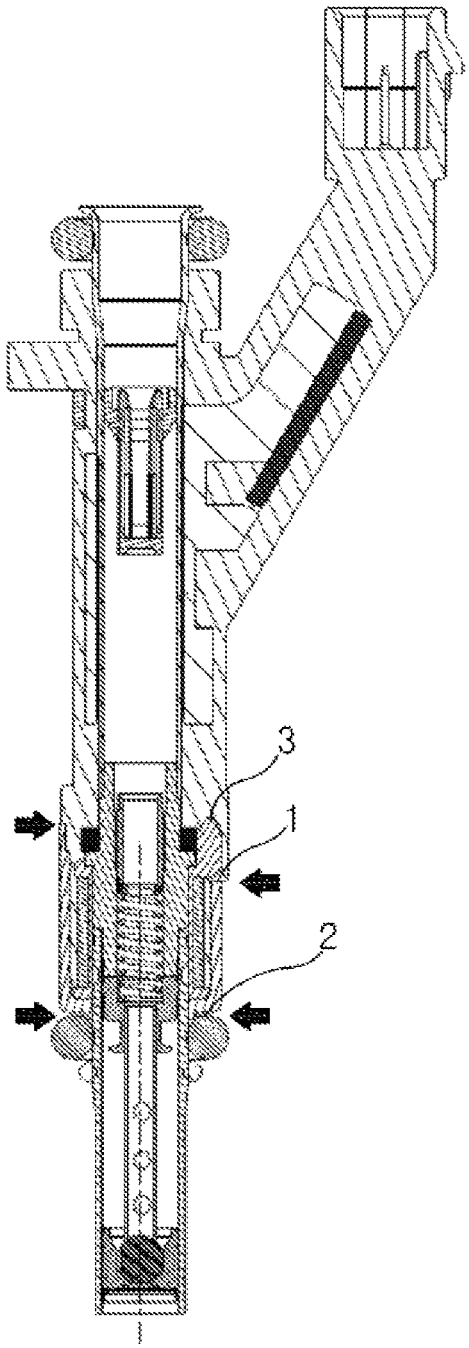
FIG. 1 is a cross-sectional view illustrating a moisture inflow path in an injector of related art.

Exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 2:
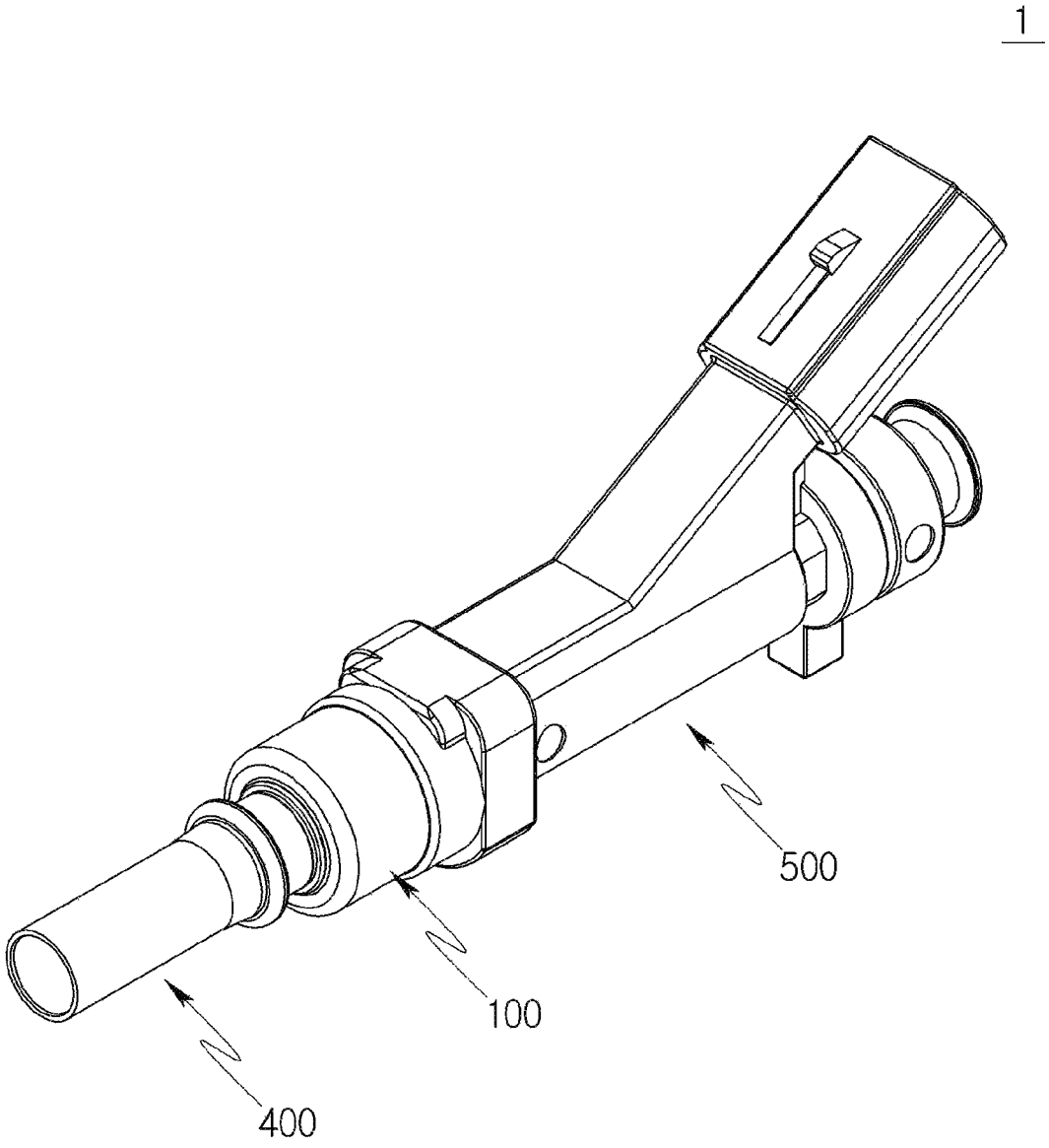
FIG. 2 is a perspective view illustrating an injector according to an exemplary embodiment of the present disclosure.

For the understanding of the present disclosure, an injector according to an embodiment of the present disclosure will be described with reference to FIGS. 2 and 3. The injector may inject the fuel, which is introduced from a fuel rail (not shown), into an engine (not shown) with one axial end thereof coupled to the fuel rail and the other axial end thereof coupled to the engine. The injector may include a housing 100, an electromagnetic generation unit 200, a core 300, a lead pipe 400, a molding unit 500, a cover 600, an extension tube 10, a power supply unit 20, a tube 30, a restoring spring 40, an armature 50, a needle shaft 60, a ball 70, a valve seat 80, and an orifice 90.

The electromagnetic generation unit 200 may be accommodated in the housing 100, the core 300 and the lead pipe 400 may be inserted into the electromagnetic generation unit 200, and the cover 600 may be fitted to the outer peripheral surface of the core 300. The fuel-rail-side end of the core 300 may be fitted to the inner peripheral surface of the extension tube 10, and the engine-side end of the core 300 may be fitted to the inner peripheral surface of the lead pipe 400. The tube 30 may be inserted into the inner peripheral surface of the core 300, and the armature 50 may be inserted into the inner peripheral surface of the lead pipe 400. The restoring spring 40 may be disposed between the tube 30 and the armature 50. The needle shaft 60 may be rectilinearly movable through the armature 50, the fuel-rail-side end of the needle shaft 60 may supportably abut the restoring spring 40, and the engine-side end of the needle shaft 60 may abut the ball 70. The ball 70 may be accommodated in the valve seat 80, and the orifice 90 may be disposed at the engine-side end of the valve seat 80. The electromagnetic generation unit 200 may be electrically connected to the power supply unit 20. The molding unit 500 may be formed to enclose the extension tube 10, the power supply unit 20, the housing 100, the electromagnetic generation unit 200, the core 300, the lead pipe 400, and the cover 600.

Figure 3:
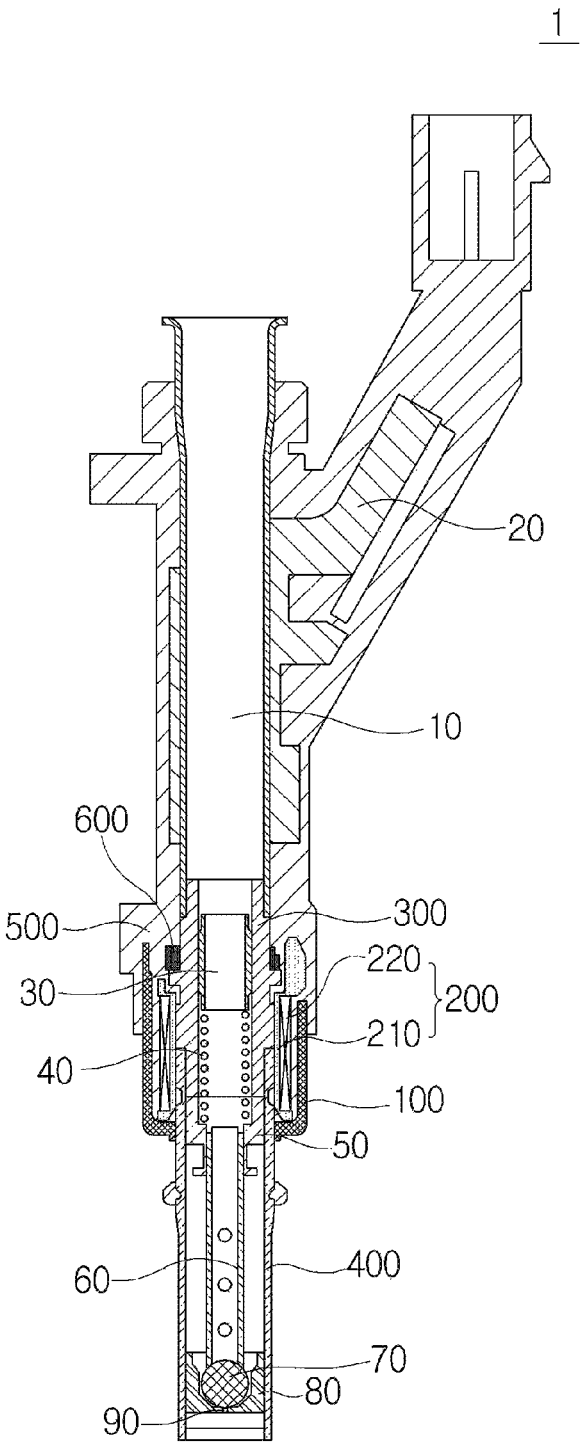
FIG. 3 is a cross-sectional view of FIG. 2 according to the exemplary embodiment of the present disclosure.

Referring to FIG. 3, the injector according to the exemplary embodiment of the present disclosure may include the housing 100, the electromagnetic generation unit 200, the core 300, the lead pipe 400, the molding unit 500, and the cover 600. The housing 100 may include a cylindrical shape that is open at the fuel-rail-side end thereof and accommodate the electromagnetic generation unit 200, the core 300, and the cover 600 therein. The lead pipe 400 may be inserted into the engine-side end of the housing 100. The open fuel-rail-side end of the housing 100 may be sealed by the molding unit 500.

Figure 4:
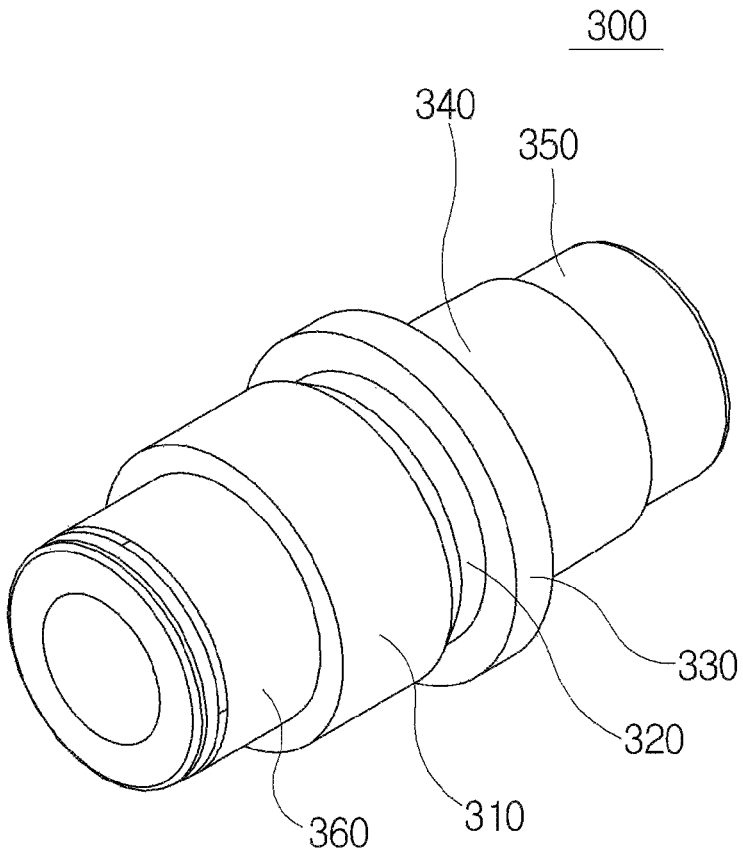
FIG. 4 is a perspective view illustrating a core in the injector according to the exemplary embodiment of the present disclosure.
Figure 5:
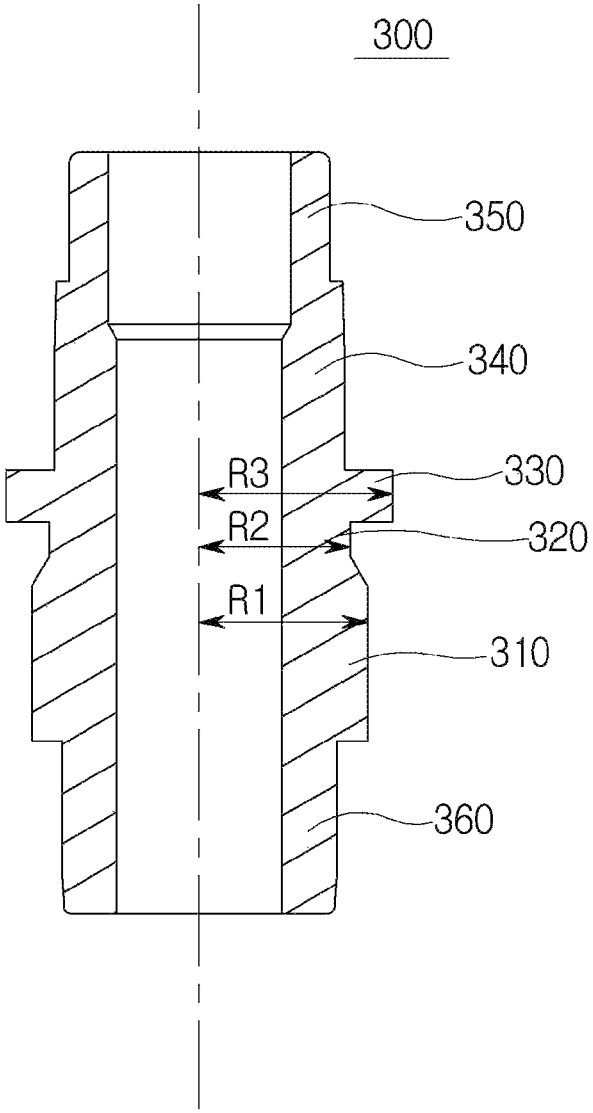
FIG. 5 is a cross-sectional view of FIG. 4 according to an exemplary embodiment of the present disclosure.

Referring to FIGS. 3 to 5, the core 300 may include a cylindrical shape to allow the fuel-rail-side end thereof to be inserted into the extension tube 10 and the engine-side end thereof to be inserted into the electromagnetic generation unit 200. The core 300 may include an insertion part 310, a molding coupling part 320, a coupling jaw part 330, a cover coupling part 340, a fuel inflow part 350, and a pipe coupling part 360. The insertion part 310 may have an outer diameter R1 that corresponds to the inner diameter of the electromagnetic generation unit 200 to allow the insertion part 310 to be fitted to the inner peripheral surface of the electromagnetic generation unit 200. The molding coupling part 320 may extend axially from the insertion part 310 and have an outer diameter R2 smaller than the outer diameter R1 of the insertion part 310 (R2<R1). The coupling jaw part 330 may have an outer diameter R3 greater than the outer diameter R1 of the insertion part 310 to allow the coupling jaw part 330 to be seated to and supported by the electromagnetic generation unit 200. The cover coupling part 340 may have an outer diameter that corresponds to the inner diameter of the cover 600 since the cover coupling part 340 is coupled to the outer peripheral surface of the cover 600. The fuel inflow part 350 may have an outer diameter that corresponds to the inner diameter of the extension tube 10 since the fuel inflow part 350 is fitted to the extension tube 10. The pipe coupling part 360 may have an outer diameter that corresponds to the inner diameter of the lead pipe 400 since the pipe coupling part 360 is fitted to the inner peripheral surface of the lead pipe 400.

Figure 6:
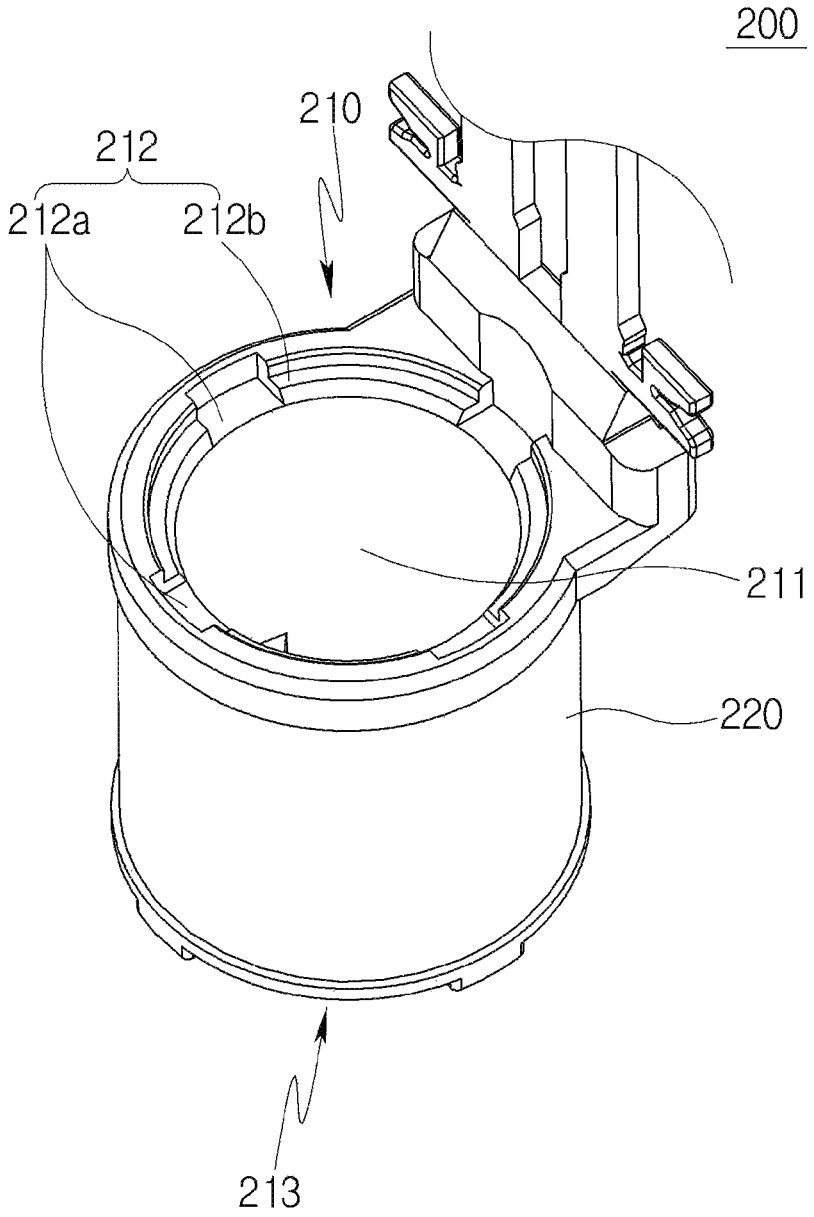
FIG. 6 is a perspective view illustrating an electromagnetic generation unit in the injector according to the exemplary embodiment of the present disclosure.
Figure 7:
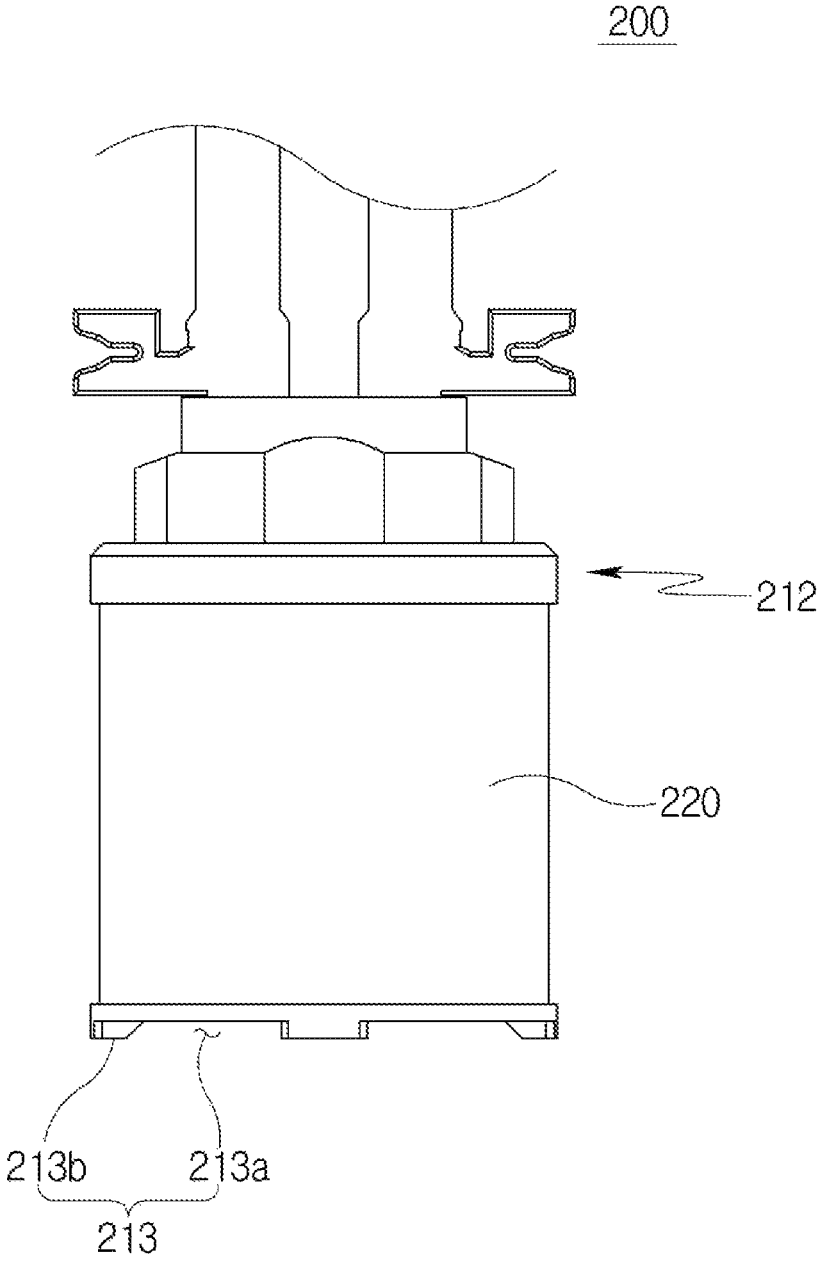
FIG. 7 is a side view illustrating the electromagnetic generation unit in the injector according to the exemplary embodiment of the present disclosure.

Referring to FIGS. 3, 6, and 7, the electromagnetic generation unit 200 may be accommodated in the housing 100 and include a bobbin 210 and a coil 220 while the core 300 and the lead pipe 400 are inserted into the electromagnetic generation unit 200. The coil 220 may be wound on the outer peripheral surface of the bobbin 210. The bobbin 210 may include a bobbin body 211, a first injection part 212, and a second injection part 213. The bobbin 210 may include a cylindrical shape such that the coil 220 is wound on the outer peripheral surface of the bobbin body 211, and the core 300 and the lead pipe 400 may be inserted into the inner peripheral surface of the bobbin body 211.

The first injection part 212 may be formed at the fuel-rail-side end of the bobbin body 211 and include a first molding inlet 212*a* and a core accommodation groove 212*b*. The core accommodation groove 212*b* may include a groove having inner diameter that corresponds to the outer diameter R3 of the coupling jaw part 330 to allow the coupling jaw part 330 of the core 300 to be seated on the core accommodation groove 212*b*. The first molding inlet 212*a* may be recessed circumferentially at a predetermined interval to allow the molding unit 500 to be inserted to the inner peripheral surface of the bobbin body 211. The first molding inlet 212*a* and the core accommodation groove 212*b* may be formed axially in a groove shape, and the first molding inlet 212*a* may be formed radially outward from the core accommodation groove 212*b*. Although the first molding inlet 212*a* may include four first molding inlets formed circumferentially at intervals of 90 degrees in the exemplary embodiment, the present disclosure is not limited thereto.

The second injection part 213 may be formed at the engine-side end of the bobbin body 211 and include a second molding inlet 213*a* and a housing contact part 213*b*. The housing contact part 213*b* may extend circumferentially towards the engine from the bobbin body 211. In particular, the housing contact part 213*b* may include a plurality of housing contact parts formed circumferentially for contact with the housing. The second molding inlet 213*a* may be formed in the space enclosed by the bobbin body 211, the housing contact part 213*b*, and the housing 100. Although the housing contact part 213*b* may include four housing contact parts formed circumferentially at intervals of 90 degrees in the exemplary embodiment, the present disclosure is not limited thereto.

Figure 8:
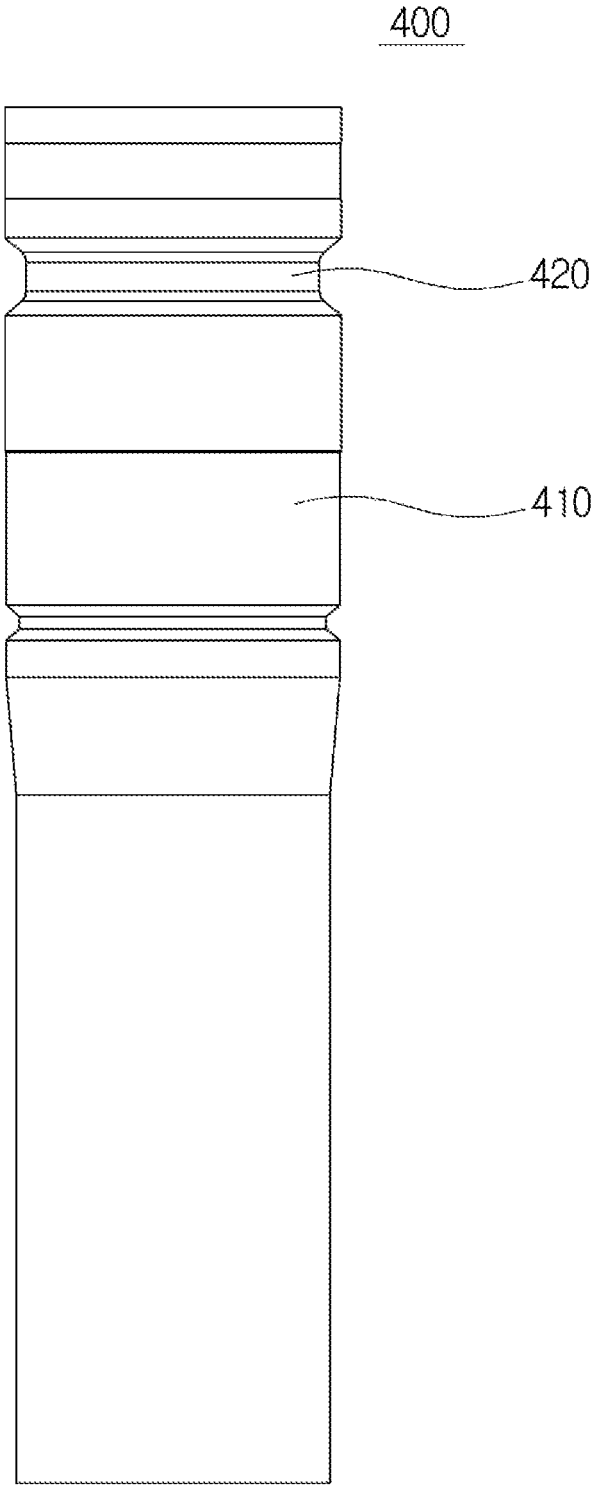
FIG. 8 is a side view illustrating a lead pipe in the injector according to the exemplary embodiment of the present disclosure.
Figure 9:
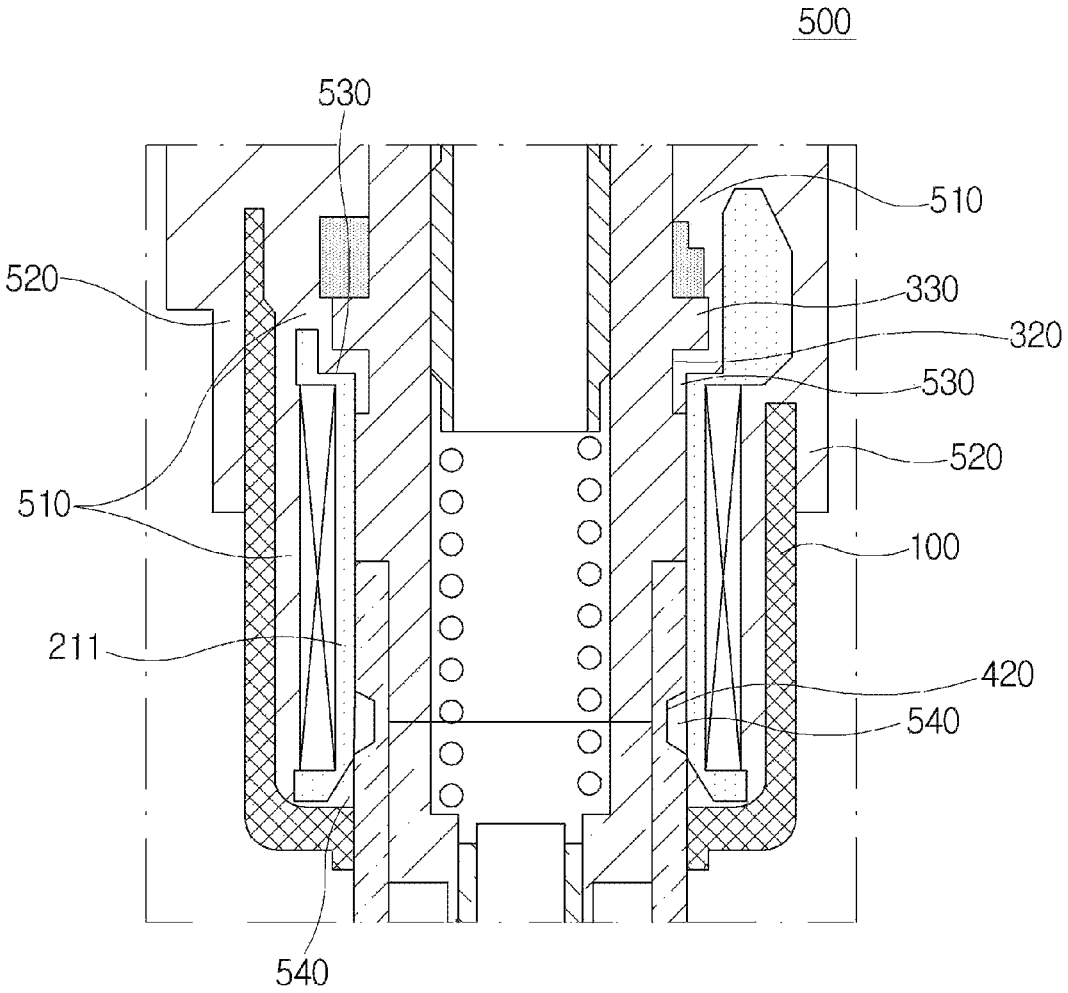
FIG. 9 is a partially enlarged view of FIG. 3 according to an exemplary embodiment of the present disclosure.
Figure 10:
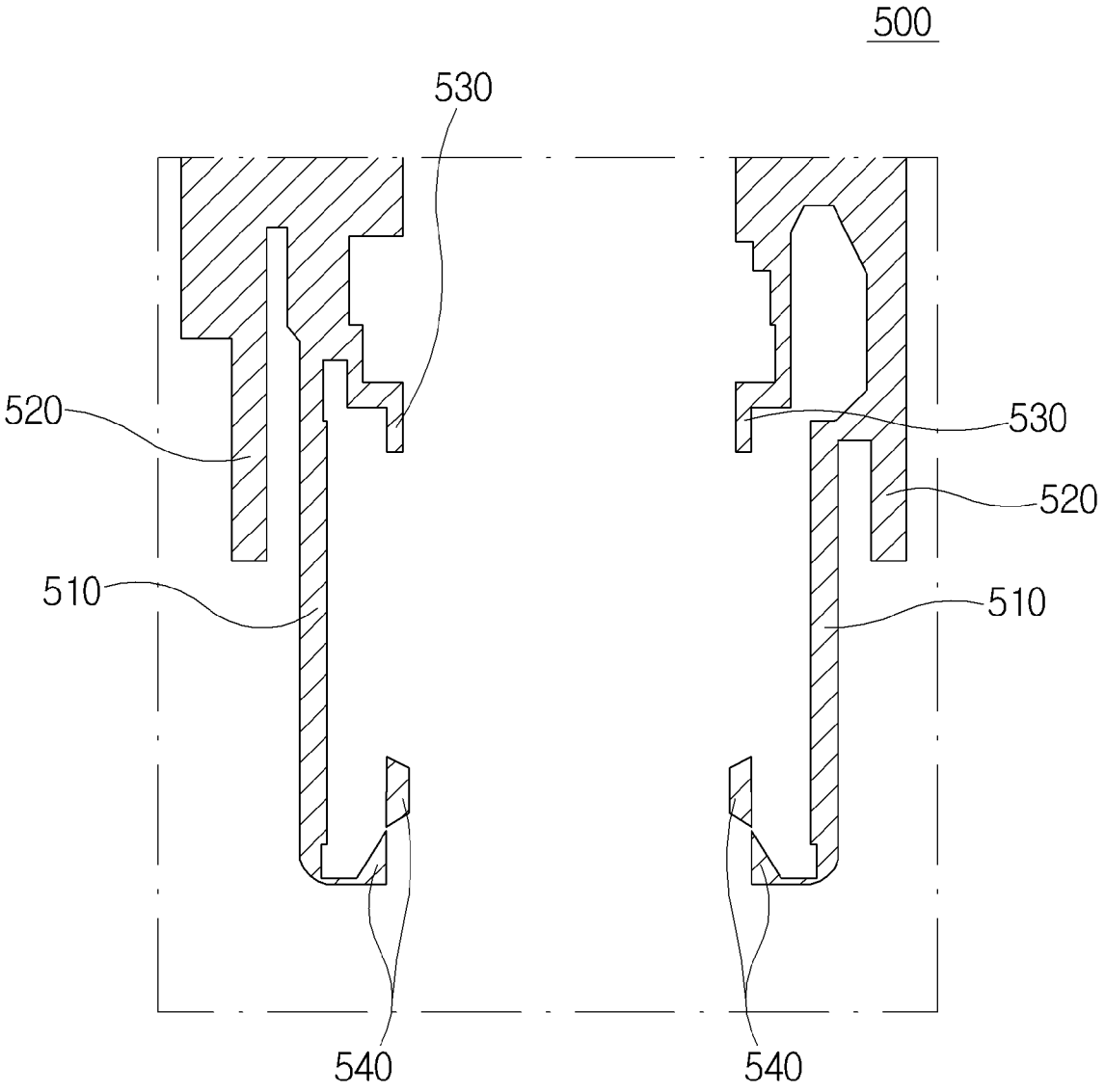
FIG. 10 is a reference view illustrating only a molding unit in FIG. 9 according to an exemplary embodiment of the present disclosure.
Figure 11:
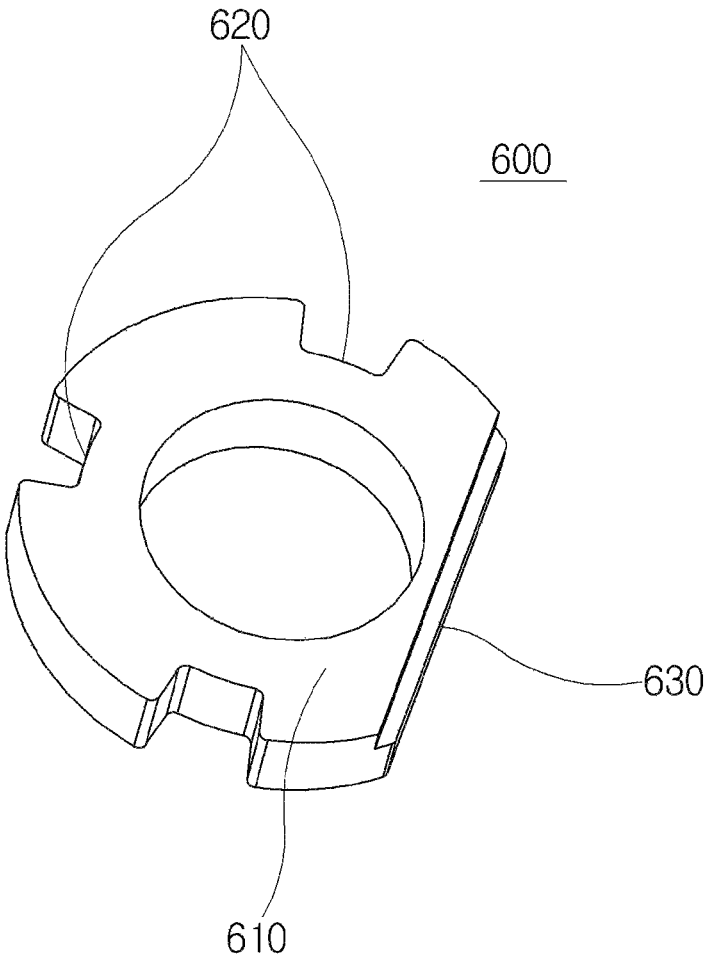
FIG. 11 is a perspective view illustrating a cover in the injector according to the exemplary embodiment of the present disclosure.

Referring to FIGS. 3 and 8, the lead pipe 400 may be inserted into the electromagnetic generation unit 200 and include a pipe body 410 and a molding accommodation part 420 while the core 300 is inserted into the lead pipe 400. The pipe body 410 may include a cylindrical shape to be inserted into the housing 100 and the electromagnetic generation unit 200. The molding accommodation part 420 may include a groove shape and may be formed circumferentially in the pipe body 410 inserted into the electromagnetic generation unit 200. In particular, a space for insertion of the molding unit 500 may be defined between the inner peripheral surface of the bobbin body 211 and the outer peripheral surface of the pipe body 410.

Referring to FIGS. 3 to 11, the molding unit 500 may be formed by injecting a plastic resin material by insert injection molding and include a molding unit body 510, a housing sealing part 520, a first sealing part 530, and a second sealing part 540. The molding unit body 510 may be accommodated in the housing 100 and enclose the outer peripheral surface of the electromagnetic generation unit 200, the outer peripheral surface of the coupling jaw part 330, and the outer peripheral surface of the cover 600. The housing sealing part 520 may be connected to the molding unit body 510 and enclose the outer peripheral surface of the housing 100. The first sealing part 530 may extend from the inner peripheral surface of the molding unit body 510, pass through the first molding inlet 212*a*, and enclose the outer peripheral surface of the molding coupling part 320. The second sealing part 540 may extend from the molding unit body 510, pass through the second molding inlet 213*a*, and enclose the inner peripheral surface of the bobbin 210 and the outer peripheral surface of the molding accommodation part 420.

In particular, the first sealing part 530 may include a plurality of first sealing parts formed circumferentially corresponding to the shape of the first molding inlet 212*a*, and each thereof may have the same inner diameter R3 as the outer diameter of the coupling jaw part 330. The first sealing part 530 may extend toward the engine and then extend radially inward. The first sealing part 530 may be connected annularly corresponding to the shape of the molding coupling part 320. The second sealing part 540 may extend circumferentially and radially inward corresponding to the shape of the second molding inlet 213*a* and extend along the inner peripheral surface of the bobbin 210. The second sealing part 540 may be connected annularly corresponding to the shape of the molding accommodation part 420.

The cover 600 may be coupled to the outer peripheral surface of the cover coupling part 340 of the core 300 and the fuel-rail-side surface of the coupling jaw part 330 and include a cover body 610, an injection groove 620, and a cut part 630. The cover body 610 may have an outer diameter greater than the outer diameter R3 of the coupling jaw part 330 to axially cover the coupling jaw part 330. The injection groove 620 may be recessed radially inward from the cover body 610 corresponding to the position of the first molding inlet 212*a* for exposure of the first molding inlet 212*a*. The cut part 630 may be formed in such a manner that the cover body 610 is cut in stages (e.g., steps) in a direction parallel to the axis thereof to enlarge the insertion space of the molding unit 500.

The effect of the injector according to the exemplary embodiment of the present disclosure will be described with reference to FIGS. 2 to 11. The injector may be improved since the bobbin 210 may include the first and second molding inlets 212*a* and 213*a*, and the molding unit 500 may be inserted to the inner peripheral surface of the bobbin 210. In the conventional injector as illustrated in FIG. 1 of the related art, since both axial ends of the bobbin are in contact with the core and the housing, the molding unit is not inserted to the inner peripheral surface of the bobbin. Hence, a space is generated between the bobbin and the core or between the core and the housing under the condition of high or low temperature or high moisture, and a failure occurs due to short circuit when moisture flows into the space 1 or 2 (in the direction indicated by the arrows) and reaches a terminal 3, to which electric power is applied, through the space which is not filled with resin, in the injector.

Conversely, according to the present disclosure, since the gap between the bobbin 210 and the core 300 is sealed by the first sealing part 530 and the gap between the bobbin 210 and the housing 100 is sealed by the second sealing part 540, the introduction of moisture may be prevented even in harsh environments.

In order for the molding unit 500 inserted into the first and second molding inlets 212*a* and 213*a* to perform a sufficient sealing function in the present disclosure, the molding coupling part 320 and the molding accommodation part 420 may be formed. In particular, the molding unit 500 inserted into the first and second molding inlets 212*a* and 213*a* may fully enclose the core 300 and the lead pipe 400 while the molding unit 500 is inserted along the molding coupling part 320 and the molding accommodation part 420. Therefore, the inner peripheral surface of the bobbin 210 and the space between the core 300 and the lead pipe 400 may be fully sealed by the molding unit 500.

The cover 600 may include the injection groove 620 and the cut part 630 to increase the injection efficiency of the molding unit 500. Since the molding unit 500 is inserted by insert injection molding, a space for injection into the first molding inlet 212*a* may be required. Accordingly, according to the present disclosure, the access to the first molding inlet 212*a* may be facilitated through the injection groove 620 and the cut part 630.

Furthermore, the molding unit 500 may include the housing sealing part 520 to increase a molding length to cover the outer peripheral surface of the housing 100. The open end of the housing is exposed to the outside in the related art, with the consequence that moisture is introduced through the open end of the housing more easily. However, since the open axial end of the housing 100 and the outer peripheral surface of the housing 100 are sealed through the housing sealing part 520 in the present disclosure, the introduction of moisture may be further reduced.

Table 1 indicates a result of testing insulation performance using the conventional injector. It can be seen in the present test (cold water shock) that when the injector is exposed for 1 hour at 140° C. and then immersed for 5 minutes at 0° C. to 4° C., the failure of insulation resistance (less than 10 MΩ) is caused due to short circuit in all samples. The insulation resistance is a reference for measuring insulation performance. The resistance value of the insulation resistance is obtained by applying a high voltage between the terminal of the injector and the constituent metal component (housing, etc.) of the injector body and measuring an amount of current. When the resistance value is 10 MΩ or more, it means that current hardly flows (e.g., insulation is maintained).

In addition, the insulation performance refers to the ability to block current from flowing to other components other than the coil of the injector. Therefore, it may be interpreted that when the insulation resistance is low (less than 10 MΩ), current may flow to other components and short circuit may occur in the engine when the injector is mounted to the engine.

TABLE 1

| Test Item | Sample No. | Before Test [MΩ] | After Test [MΩ] | Result |
|---|---|---|---|---|
| Cold Water Shock | 1 | Normal (10 or more) | 1.4 | Bad |
| | 2 | Normal (10 or more) | 0.1 | Bad |
| | 3 | Normal (10 or more) | 0.3 | Bad |
| | 4 | Normal (10 or more) | 0.2 | Bad |
| | 5 | Normal (10 or more) | 0.1 | Bad |
| | 6 | Normal (10 or more) | 0.2 | Bad |

In contrast, the injector according to the present disclosure may satisfy that the reference value of the insulation resistance is 10 MΩ or more under the cold water shock condition as shown in Table 2.

TABLE 2

| Test Item | Sample No. | Before Test [MΩ] | After Test [MΩ] | Result |
|---|---|---|---|---|
| Cold Water Shock | 1 | Normal (10 or more) | Normal (10 or more) | Pass |
| | 2 | Normal (10 or more) | Normal (10 or more) | Pass |
| | 3 | Normal (10 or more) | Normal (10 or more) | Pass |
| | 4 | Normal (10 or more) | Normal (10 or more) | Pass |
| | 5 | Normal (10 or more) | Normal (10 or more) | Pass |
| | 6 | Normal (10 or more) | Normal (10 or more) | Pass |

Therefore, according to the present disclosure, introduction of moisture may be prevented even in harsh environments, and an occurrence of failure due to short circuit may be reduced.

As is apparent from the above description, the injector according to the present disclosure may prevent an occurrence of failure due to short circuit by sealing the housing and sealing the gap between the bobbin and the core and the gap between the bobbin and the lead pipe to block the introduction of moisture even in harsh environments.

While the present disclosure has been described with respect to the exemplary embodiments illustrated in the drawings, it will be obvious to those skilled in the art that such embodiments are provided by way of example only. It will be understood by those skilled in the art that various modifications and other equivalent embodiments may be made without departing from the spirit and scope of the disclosure as defined in the following claims.

It will be apparent to those skilled in the art that simple variations and modifications pertain to the present disclosure and the specific protection scope of the present disclosure should be defined by the appended claims.

What is claimed is:

1. An injector for supplying an engine with fuel introduced from a fuel rail, comprising:

a housing;

an electromagnetic generation unit accommodated in the housing and formed by winding a coil on an outer peripheral surface of a bobbin to generate an electromagnetic field when electric power is applied to the electromagnetic generation unit;

a core inserted into a fuel-rail-side end of the bobbin to form a magnetic circuit using the electromagnetic field generated in the electromagnetic generation unit;

a lead pipe inserted into an engine-side end of the bobbin to form the magnetic circuit by coupling with the core;

a molding unit that encloses the electromagnetic generation unit and an outer peripheral surface of the core to block introduction of moisture, wherein the molding unit is inserted into a space between an inner peripheral surface of the bobbin and the outer peripheral surface of the core to seal a gap between the electromagnetic generation unit and the core; and a cover coupled to the outer peripheral surface of the core to form the magnetic circuit together with the core, wherein the core comprises:

an insertion part inserted into the inner peripheral surface of the bobbin to form the magnetic circuit by coupling with the electromagnetic generation unit;

a molding coupling part connected to a fuel-rail-side end of the insertion part and having an outer diameter smaller than the insertion part for insertion of the molding unit; and a coupling jaw part connected to a fuel-rail-side end of the molding coupling part, wherein the coupling jaw part supports the cover and has an outer diameter greater than the insertion part to allow the coupling jaw part to be accommodated in the bobbin, and wherein the molding unit comprises:

a molding unit body accommodated in the housing and formed to enclose an outer peripheral surface of the electromagnetic generation unit, an outer peripheral surface of the coupling jaw part, and an outer peripheral surface of the cover;

a housing sealing part formed to extend from the molding unit body to seal a fuel-rail-side end of the housing; and a first sealing part formed to extend from an inner peripheral surface of the molding unit body, wherein the first sealing part connected annularly encloses an outer peripheral surface of the molding coupling part to seal the gap between the bobbin and the core.

2. The injector according to claim 1, wherein the bobbin comprises:

a bobbin body, wherein the coil is wound on an outer peripheral surface of the bobbin body, and the core and the lead pipe are inserted into an inner peripheral surface of the bobbin body; and a first injection part connected to a fuel-rail-side end of the bobbin body, wherein the first injection part includes a core accommodation groove formed circumferentially for accommodation of the coupling jaw part and includes a first molding inlet into which the molding unit is inserted to prevent introduction of moisture.

3. The injector according to claim 2, wherein the bobbin further comprises:

a second injection part connected to an engine-side end of the bobbin body, wherein the second injection part supportably abuts the housing and includes a second molding inlet into which the molding unit is inserted to prevent introduction of moisture.

4. The injector according to claim 3, wherein the molding unit further comprises:

a second sealing part formed to extend from the molding unit body, wherein the second sealing part passes through the second molding inlet and encloses the inner peripheral surface of the bobbin.

5. The injector according to claim 2, wherein the cover has a diameter greater than the coupling jaw part to axially cover the coupling jaw part, includes an injection groove formed for exposure of the first molding inlet, and includes a cut part formed to enlarge an insertion space of the molding unit.

6. The injector according to claim 1, wherein the lead pipe comprises:

a pipe body inserted into the bobbin; and a molding accommodation part formed on an outer peripheral surface of the pipe body and formed circumferentially in a groove shape for accommodation of the molding unit.

* * * * *